US006619181B1

(12) United States Patent
Frey et al.

(10) Patent No.: US 6,619,181 B1
(45) Date of Patent: Sep. 16, 2003

(54) APPARATUS FOR REVERSING THE DETONABILITY OF AN EXPLOSIVE IN ENERGETIC ARMOR

(75) Inventors: Robert B. Frey, Bel Air, MD (US); Michael J. Zoltoski, Bel Air, MD (US); Deborah Pilarski, Jarrettsville, MD (US); Jerry Lee Watson, Darlington, MD (US); John J. Starkenberg, Owings Mills, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/146,118

(22) Filed: May 16, 2002

(51) Int. Cl.[7] ..... F41H 11/00
(52) U.S. Cl. ..... 89/36.17; 428/911
(58) Field of Search ..... 89/36.17; 109/36, 109/37; 428/911

(56) References Cited

U.S. PATENT DOCUMENTS 3,592,148 A * 7/1971 Manis ..... 109/37
4,368,660 A * 1/1983 Held ..... 89/36.17
5,070,764 A * 12/1991 Shevach et al. ..... 89/36.17
5,149,911 A * 9/1992 Ringbloom et al. ..... 102/302
5,637,824 A * 6/1997 Benyami ..... 89/36.17
5,811,712 A * 9/1998 Held ..... 89/36.17
5,922,986 A * 7/1999 Wanninger et al. ..... 89/36.17
6,021,703 A * 2/2000 Geiss et al. ..... 89/36.17

* cited by examiner

*Primary Examiner*—Michael J. Carone
*Assistant Examiner*—M. Thomson
(74) *Attorney, Agent, or Firm*—Williiam W. Randolph

(57) ABSTRACT

A reactive armor includes an orderly stack of multiple leaves of explosive, interleaved with non-explosive compressible foam. The stack is enclosed between armor plates. The armor plates are moveable between a first position in which the stack is compressed and a second position in which the stack is not compressed. An igniter is in electrical communication with the leaves of explosive. Each of the multiple leaves of explosive has a thickness below the "detonation failure thickness" of the explosive. In the compressed state, the compressible foam is compressed and the explosive leaves are sufficiently close to support detonation. In the uncompressed state the compressible foam is expanded and the explosive leaves are not sufficiently close to support detonation, and the use of highly plasticized explosives prevents other types of explosion. The invention provides for switching the reactive armor between an explosive state and a non-explosive state.

19 Claims, 1 Drawing Sheet

APPARATUS FOR REVERSING THE DETONABILITY OF AN EXPLOSIVE IN ENERGETIC ARMOR

STATEMENT OF GOVERNMENT INTEREST

The invention described herein may be manufactured and used by or for the Government of the United States of America for governmental purposes without the payment of any royalties therefor.

BACKGROUND OF THE INVENTION

The invention relates in general to armor for protection from a projectile, and, in particular to armor that includes an explosive device.

There are various types of armor and armor systems used for protecting equipment from metal fragments, bullets and projectiles. Conventional armor is thick steel plate that is designed and manufactured for hardness and strength. Improvements in projectile technology have been responded to in armor technology by increasing the thickness of armor plate. However, there are practical limits to the thickness of any armor because of the weight that can be carried by military vehicles such as tanks, armored personnel carriers and like armored vehicles and still be militarily effective.

Reactive armor has been developed to overcome the weight limitations of armor plate. Reactive armor, and closely related concepts known as active armor, active protection, energetic armor, and smart armor, includes a layer or layers of explosive material positioned under an external layer or layers of armor. Any projectile penetrating the external layer of armor sets off the explosive material, resulting in a detonation that defeats the projectile.

U.S. Pat. No. 4,989,493 to E. J. Blommer et al. discloses a laminated structure for attenuating explosive shock waves. The structure includes layers of aluminum, plastic and rigid foam. The laminated structure is used to attenuate the explosive force of an accidental explosion thereby preventing sympathetic detonation of adjacent equipment.

U.S. Pat. No. 5,811,712 to M. Held discloses reactive armor. The reactive armor includes an explosive layer, a retardation layer, a flexibly displaceable front layer and an immovable rear wall layer.

U.S. Pat. No. 5,070,764 to H. Shevach discloses reactive armor. The reactive armor includes an explosive layer sandwiched between a first set of two metal plates and at least one passive mass and energy consuming assembly comprising a layer of non-explosive swellable material sandwiched between a second set of two metal plates. The swellable material is caused to swell to urge the two metal plates of the passive assembly to move apart. This action produces a mass and energy consumption to attenuate and mitigate the impact of armor piercing kinetic energy projectiles.

U.S. Pat. No. 4,981,067 to C. N. Kingery discloses reactive armor. The armor comprises a series of non-overlapping armor plates. Sandwiched between the armor plate is an explosive layer. The plates include a plurality of small holes that reduce the mass of the reactive armor.

SUMMARY OF THE INVENTION

A reactive armor in accordance with the invention includes an orderly stack of multiple leaves of solid explosive material, interleaved with solid, compressible foam. An armor plate provides means for compressing the stack. The armor plate is moveable between a first position in which the stack is compressed and a second position in which the stack is uncompressed. An igniter is in communication with the leaves of explosive.

Each of the multiple leaves of solid explosive has a thickness below the "detonation failure thickness" of the explosive. The "detonation failure thickness" is defined as the thickness below which a sample of the explosive material is not capable of supporting detonation. In the compressed state, the compressible foam is compressed and the explosive leaves are sufficiently close to support detonation. In the uncompressed state the compressible foam is expanded and the explosive leaves are not sufficiently close to support detonation.

The invention is useful as reactive armor on an armored military vehicle. The invention provides for switching the reactive armor between an explosive state and a non-explosive state by compressing and uncompressing the stack.

DETAILED DESCRIPTION OF THE PREFERRED EMBODIMENTS

Figure 1:
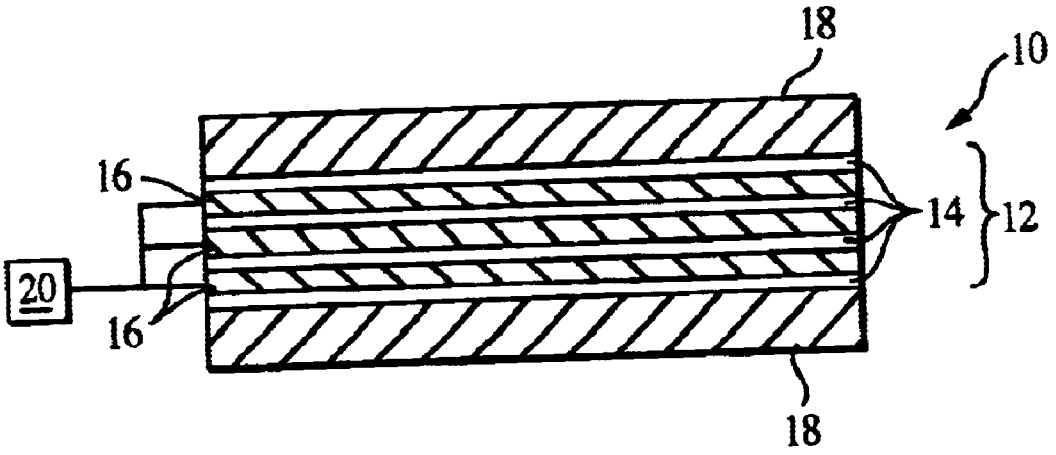
FIG. 1 is a schematic cross-sectional view of an embodiment of the invention in the compressed state.

Reactive armor, smart armor and active protection systems all use an explosive in combination with armor plate to defeat a projectile, such as a shaped charge or kinetic energy penetrator. The difference between reactive armors, smart armors and active protective systems is the means by which the explosive is initiated. The explosive in a reactive armor is directly initiated by impact of a penetrator. The detonating explosive throws a plate that disrupts the penetrator. A smart armor senses the impact of a penetrator by means of a sensor and the explosive launches a bar that disrupts the penetrator inside the outer envelope of the armor. In an active armor, a sensor detects the projectile before it hits the vehicle and an "effector" is launched at the penetrator to defeat the projectile before it hits the vehicle. The mechanism of launching the effector may include explosives. These armors offer significant weight reductions as compared to equally effective passive armors.

Reactive armor, smart armor and active protection systems all have limitations on their storage and transportation because the explosive they carry are subject to administrative and transportation regulations. It is a challenge to comply with all the regulations concerning moving and storing explosives and to maintain a high degree of combat readiness. For example, it may not be permitted to keep a fully operational armored vehicle in peacetime. It may be required that the reactive armor be stored in an explosive storage magazine remote from the armored vehicle. Further, there is always the potential for the explosive in reactive armor to detonate by accident. Accidental detonation could launch fragments a considerable distance from the armored vehicle.

An apparatus containing explosive or propellant is classified as hazardous in accordance with Department of Defense (DOD) Technical Bulletin 700-2. Based on this hazard classification, explosives and propellants are subject to rules for storage specified in the DOD Ammunition and Explosive Safety Standards, DOD 6055.9-STD. An apparatus that has the potential of detonating and throwing fragments is ordinarily classified as Hazard Class Divisions 1.1 or 1.2. Recent armor systems have been classified as 1.2 and therefore must be stored in a magazine that is at least 400 feet from any inhabited building and at least 240 feet from a public road. Some armor systems have been classified as Hazard Division 1.4, which requires at least 100 feet separation from an inhabited building or a public road. Very insensitive explosives have been used for reactive armor. However, reactive armors are most effective when the explosive is detonable, and when the explosive is detonable, it is very difficult to obtain a 1.4s hazard classification. The present invention is a reactive armor that contains a detonable explosive material when it is switched on but that may be classified as 1.4s when it is switched off. Ordnance classified as Hazard Division 1.4s is easily stored and transported.

Explosive sensitivity is a physical property that is influenced by several parameters. It is known that a highly plastic explosive that flows without fracture on impact is much less likely to explode on impact or in a fire.

The present invention relies on the detonation failure thickness property of an explosive. The detonation failure thickness is the minimum thickness of a sheet of the explosive that will sustain detonation. Detonation failure thickness is not presently calculable, but is a physical property that is measurable in the laboratory.

All solid explosives have a measurable failure thickness. Failure thickness is the minimum thickness of a sheet of explosive that will sustain detonation. Applicants have found that solid explosives can be combined with inert binders to adjust the failure thickness of a sample. Examples of such explosives include: RDX (1,3,5-trinitro-1,3,5-triazacyclohexane); HMX (1,3,5,7-tetraazacyclooctane); and PETN (pentaerythritol tetranitrate).

The explosive AX is a highly plastic explosive useful in the invention. It has a detonation failure thickness of 3.5 millimeters (mm). The explosive AX is a mixture of 30 wt. % PETN (pentaerythritol tetranitrate);

30 wt. % RDX (1,3,5-trinitro-1,3,5-triazacyclohexane);

13.3 wt % of a styrene-ethylene/butylenes-styrene block copolymer, commercially available from Shell Oil Company under the trade name Kraton® G1653; and 26.7 wt % of a white mineral oil, commercially available under the trade name Duoprime®.

According to the invention, a sheet of solid explosives is formed. The sheet has a thickness below the detonation failure thickness of the explosive. The sheet of solid explosive is cut into leaves and assembled into an orderly stack of leaves. Separating each leaf from the adjoining leaf is an interleaf of resilient, low-density, non-explosive compressible foam. The assembled stack comprises multiple leaves of explosive separated by interleaves of non-explosive compressible foam.

Compressible, non-explosive foams are known which when fully expanded have a porosity of up to 99%, often 75% to 99%, typically 86% to 98%. In the state in which each foam interleaf is fully expanded, no leaves of explosive are in contact and each leaf of explosive has a thickness below the detonation failure thickness. The stack can also be compressed to a density approaching that of the solid explosive. In this compressed state the stack has a thickness above the detonation failure thickness of the explosive. The stack is therefore explosive. It is apparent that the stack can be switched from a non-explosive state to an explosive state by compressing the stack to a thickness above the detonation failure thickness of the explosive. Similarly, the stack can be switched form an explosive state to a non-explosive state by releasing the compressed stack, allowing all compressible foam interleaves to expand to their fully expanded state, thereby separating the explosive leaves.

The number of leaves of explosive in the stack is determined by reactive armor design parameters. That is, the total weight of explosive for the reactive armor apparatus is selected according to design parameters. A number of explosive leaves is selected which achieves the total weight of explosive required. This may be, by way of example, 2, 5, 10, 20 or more leaves of explosive in the stack.

In the fully expanded state, the stack will not detonate, even if ignited, for example, by a detonator in communication with each leaf of explosive. In the compressed state, the entire stack will detonate together when ignited by a detonator. Compression is effected by any functionally convenient compression means, such as an armor plate and lever, armor plate and pivot, armor plate and scissors mechanism or a similar mechanism.

A switchable explosive stack can be assembled from highly plasticized explosive. It is known that highly plasticized explosives are resistant to non-detonative explosions when subjected to ballistic impact and are pyrophoric but not explosive when subjected to fire. This invention controls the occurrence of detonation by control of failure thickness and the occurrence of non-detonative explosions by using highly plasticized explosives. Therefore, the invention makes it possible to fabricate reactive armor that will neither detonate nor burn explosively when switched off. The same reactive armor will react explosively to impact when switched on. Accordingly, a military vehicle including reactive armor of the invention can be safely stored or transported with the reactive armor in the non-explosive state. The reactive armor can be switched to the explosive state when in a hostile environment for defense against a projectile.

Figure 2:
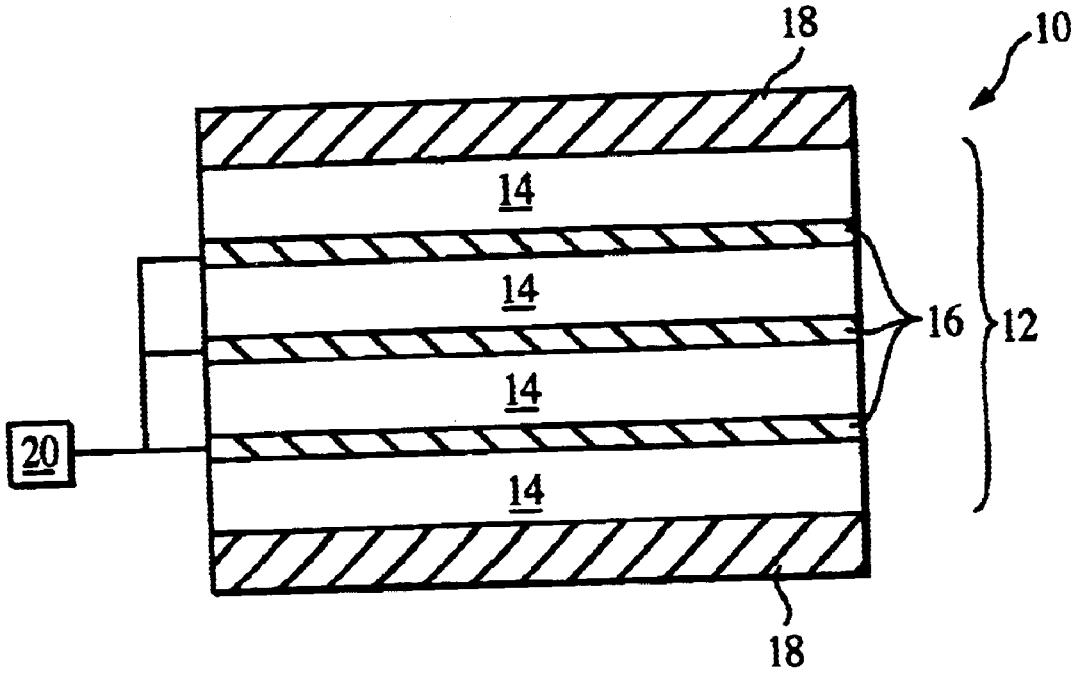
FIG. 2 is a schematic cross-sectional view of the embodiment of FIG. 1 in the uncompressed state.

FIG. 1 is a schematic cross-sectional view of an embodiment of the invention in the compressed state and FIG. 2 is a schematic cross-sectional view of the embodiment of FIG. 1 in the uncompressed state. A reactive armor 10 comprises a stack 12 including leaves 16 of explosive material. Each leaf 16 has a thickness less than the detonation thickness of the explosive material. Stack 12 further includes interleaves 14 of non-explosive, compressible material.

Reactive armor 10 includes a means 18 for compressing the stack 12 between a first, compressed position (FIG. 1) in which the interleaves 14 are compressed and the leaves 16 of explosive material are in explosive communication and a second, uncompressed position (FIG. 2) in which the interleaves 14 are not compressed and the leaves 16 of explosive material are not in explosive communication. An igniter 20 is in electrical communication with the leaves 16 of explosive material. The means 18 for compressing the stack may be, for example, an armor plate and lever, armor plate and pivot, armor plate and scissors or other known compressing mechanisms.

EXAMPLE

The explosive AX is a highly plastic explosive useful for the invention. AX explosive was pressed into a 2-millimeter thick sheet. Leaves were cut from the sheet. Two leaves of explosive with a compressible foam interleaf were formed into a stack. The stack was placed between two armor plates. The AX leaves were connected to a detonator. An aluminum witness plate was attached along the side of the stack.

The detonator was activated and any detonation of the AX explosive left a mark on the witness plate. A detonation mark was recorded as "Detonation" and no mark was recorded as "No Detonation" as the result, reported in Table 1. The following data were recorded.

TABLE 1

Results of Detonation Propagation Experiments

| Example | AX Explosive Thickness | Foam Type | Foam Thickness | Foam Porosity | Result |
|---|---|---|---|---|---|
| 1. | 2.1 mm | Dow ® R5 Polystyrene | 6.6 mm | 98% Uncompressed | No Detonation |
| 2. | 2.1 mm | Dow ® R5 Polystyrene | 4.1 mm | 86% Uncompressed | No Detonation |
| 3. | 2.1 mm | Kapton ® Polyimide | 0.076 mm | 0% Fully Compressed | Detonation |
| 4. | 2.1 mm | Polyurethane Cushion | 12.7 mm | 99% Uncompressed | No Detonation |
| 5. | 2.1 mm | Polyurethane Cushion | 0.3 mm | 50% Partially Compressed | Detonation |
| 6. | 2.1 mm | Polyurethane Cushion | 0.6 mm | 50% Partially Compressed | Detonation |
| 7. | 2.2 mm | Polyurethane Cushion | 0.9 mm | 50% Partially Compressed | No Detonation |
| 8. | 2.0 mm | Poron ® Polyurethane | 0.9 mm | 67% Uncompressed | No Detonation |
| 9. | 2.0 mm | Poron ® Polyurethane | 0.45 mm | 35% Partially Compressed | Detonation |

The foregoing discussion discloses and describes embodiments of the present invention by way of example. One skilled in the art will readily recognize from this discussion and from the accompanying drawings and claims, that various changes, modifications and variations can be made therein without departing from the spirit and scope of the invention as defined in the following claims and equivalents thereof.

What is claimed is:

1. A protective device against projectiles comprising:

a stack including leaves of explosive material, each leaf having a thickness less than a detonation thickness of the explosive material, and interleaves of non-explosive, compressible material;

means for compressing the stack between a first, compressed position in which the interleaves are compressed and the leaves of explosive material are in explosive communication and a second, uncompressed position in which the interleaves are not compressed and the leaves of explosive material are not in explosive communication; and an igniter in communication with the leaves of explosive material.

2. The protective device of claim 1 wherein the non-explosive compressible material is a foam material.

3. The protective device of claim 2 wherein the non-explosive compressible material is a foam material having an uncompressed porosity of about 60% to 99%.

4. The protective device of claim 2 wherein the non-explosive compressible material is a foam material having an uncompressed porosity of about 75% to 99%.

5. The protective device of claim 2 wherein the non-explosive compressible material is a foam material having an uncompressed porosity of about 86% to 98%.

6. The protective device of claim 1 wherein the non-explosive compressible material is a polyurethane foam.

7. The protective device of claim 1 wherein the non-explosive compressible material is a polystyrene foam.

8. The protective device of claim 1 wherein the means for compressing the stack is an armor plate.

9. The protective device of claim 1 wherein the leaves of explosive material comprise plastic explosive having a thickness of less than about 3 millimeters.

10. The protective device of claim 1 wherein the explosive material is selected from the group consisting of AX, RDX, HMX and PETN.

11. A reactive armor assembly comprising:

a stack including leaves of explosive material, each leaf having a thickness less than a detonation thickness of the explosive material, and interleaves of non-explosive, compressible material;

an armor plate for compressing the stack between a first, compressed position in which the interleaves are compressed and the leaves of explosive material are in explosive communication and a second, uncompressed position in which the interleaves are not compressed and the leaves of explosive material are not in explosive communication; and an igniter in communication with the leaves of explosive material.

12. The reactive armor assembly of claim 11 wherein the non-explosive compressible material is a foam material.

13. The reactive armor assembly of claim 12 wherein the non-explosive compressible material is a foam material having an uncompressed porosity of about 60% to 99%.

14. The reactive armor assembly of claim 12 wherein the non-explosive compressible material is a foam material having an uncompressed porosity of about 75% to 99%.

15. The reactive armor assembly of claim 12 wherein the non-explosive compressible material is a foam material having an uncompressed porosity of about 86% to 98%.

16. The reactive armor assembly of claim 11 wherein the non-explosive compressible material is a polyurethane foam.

17. The reactive armor assembly of claim 11 wherein the non-explosive compressible material is a polystyrene foam.

18. The reactor armor assembly of claim 11 wherein the leaves of explosive material comprise plastic explosive having a thickness of less than about 3 millimeters.

19. The reactor armor assembly of claim 11 wherein the explosive material is selected from the group consisting of AX, RDX, HMX and PETN.

* * * * *